US007927252B1

(12) United States Patent
Jeffrey

(10) Patent No.: US 7,927,252 B1
(45) Date of Patent: Apr. 19, 2011

(54) CONDITIONING APPARATUS AND RELATED METHODS

(76) Inventor: Richard M. Jeffrey, Santa Barbara, CA (US)

( * ) Notice: Subject to any disclaimer, the term of this patent is extended or adjusted under 35 U.S.C. 154(b) by 0 days.

(21) Appl. No.: 12/655,552

(22) Filed: Dec. 31, 2009

(51) Int. Cl.
*A63B 71/00* (2006.01)

(52) U.S. Cl. ..... 482/8; 482/901; 434/247; 434/250

(58) Field of Classification Search ..... 434/11–27, 434/247, 250, 261; 482/1–9, 148, 900–902
See application file for complete search history.

(56) References Cited

U.S. PATENT DOCUMENTS

| | | | | |
|---|---|---|---|---|
| 4,657,511 | A * | 4/1987 | Allard et al. | 434/20 |
| 5,213,503 | A * | 5/1993 | Marshall et al. | 434/22 |
| 5,816,817 | A * | 10/1998 | Tsang et al. | 434/22 |
| 5,980,254 | A * | 11/1999 | Muehle et al. | 434/11 |
| 6,966,775 | B1 * | 11/2005 | Kendir et al. | 434/19 |
| 7,329,127 | B2 * | 2/2008 | Kendir et al. | 434/21 |
| 2009/0042674 | A1 * | 2/2009 | Shelton | 473/450 |

* cited by examiner

*Primary Examiner* — Glenn Richman

(57) ABSTRACT

In one embodiment, a conditioning apparatus for conditioning the hips and core structure of a user includes a target having printed thereon a movement pattern, and an illumination source spaced apart from the target. The illumination source is configured to be positioned about the user and to project a light upon the movement pattern for use as a visual reference point in response to movement of the user.

14 Claims, 3 Drawing Sheets

CONDITIONING APPARATUS AND RELATED METHODS

TECHNICAL FIELD

The disclosure herein relates to a conditioning apparatus and related methods, and more particularly to a sports conditioning apparatus having an illumination source such as a laser device to project a laser beam to a target for use as a point of reference during, among other things, operation of the conditioning device.

BACKGROUND

Laser devices are common place and find utility in thousands of highly varied applications in every section of modern society, including consumer electronics (printers and CDs), information technology, science (spectroscopy) medicine (surgery), industry (cutting), law enforcement, entertainment, and the military (rifle scope).

Lasers also find utility in recreational devices such as those associated with the well-known game of laser tag for positioning the laser on another player in the game, and sports training where, for example, a laser may be used to correctly align a golf club shaft and as an aid for the golfer to check his grip on the club and the position he assumes for addressing a golf ball.

Although associated and utilized in a variety of applications, to date, no known lasers are used in a sports conditioning device, and more specifically, in a sports conditioning apparatus wherein a laser device projects a laser beam to a target for use as a point of reference during, among other things, operation of the conditioning apparatus. Such a sports conditioning apparatus as described below, is configured and designed to improve the flexibility, strength, and control, of among other things, the hips and core structure of a user, while ingraining patterns of movement directly applicable to comparable movements used in a variety of sporting activities.

Accordingly, there exists a need for a conditioning apparatus and related methods, and more particularly to a sports conditioning apparatus having an illumination source such as a laser device to project a laser beam to a target for use as a point of reference during, among other things, operation of the conditioning device.

SUMMARY

For the purpose of summarizing the invention certain objects and advantages have been described. It is to be understood that not all such objects or advantages may be achieved in accordance with any particular embodiment. Thus, for example, those skilled in the art will recognize that the device described herein may be embodied or carried out in a manner that achieves or optimizes one advantage or group of advantages as taught herein without necessarily achieving other objects or advantages.

In one embodiment the disclosed subject matter includes a conditioning apparatus for conditioning the hips and core structure of a user. The conditioning apparatus includes a target having printed thereon a movement pattern and an illumination source spaced apart from the target. The illumination source is configured to be positioned about the user and to project a light upon the movement pattern for use as a visual reference point in response to movement of the user tracing the movement pattern with the light.

In another embodiment the disclosed subject matter includes a conditioning method for conditioning the hips and core structure of a user. The conditioning method includes positioning a target having a movement pattern printed thereon, positioning an illumination source having a light on the user, spacing apart from the target the illumination source, projecting the light onto the movement pattern, and tracing the movement pattern with the light in response to movement of the illumination source by the user.

These and other embodiments will become readily apparent to those skilled in the art from the following detailed description of the preferred embodiments having reference to the attached figures, the invention not being limited to any particular preferred embodiment(s) disclosed.

DETAILED DESCRIPTION

Figure 1:
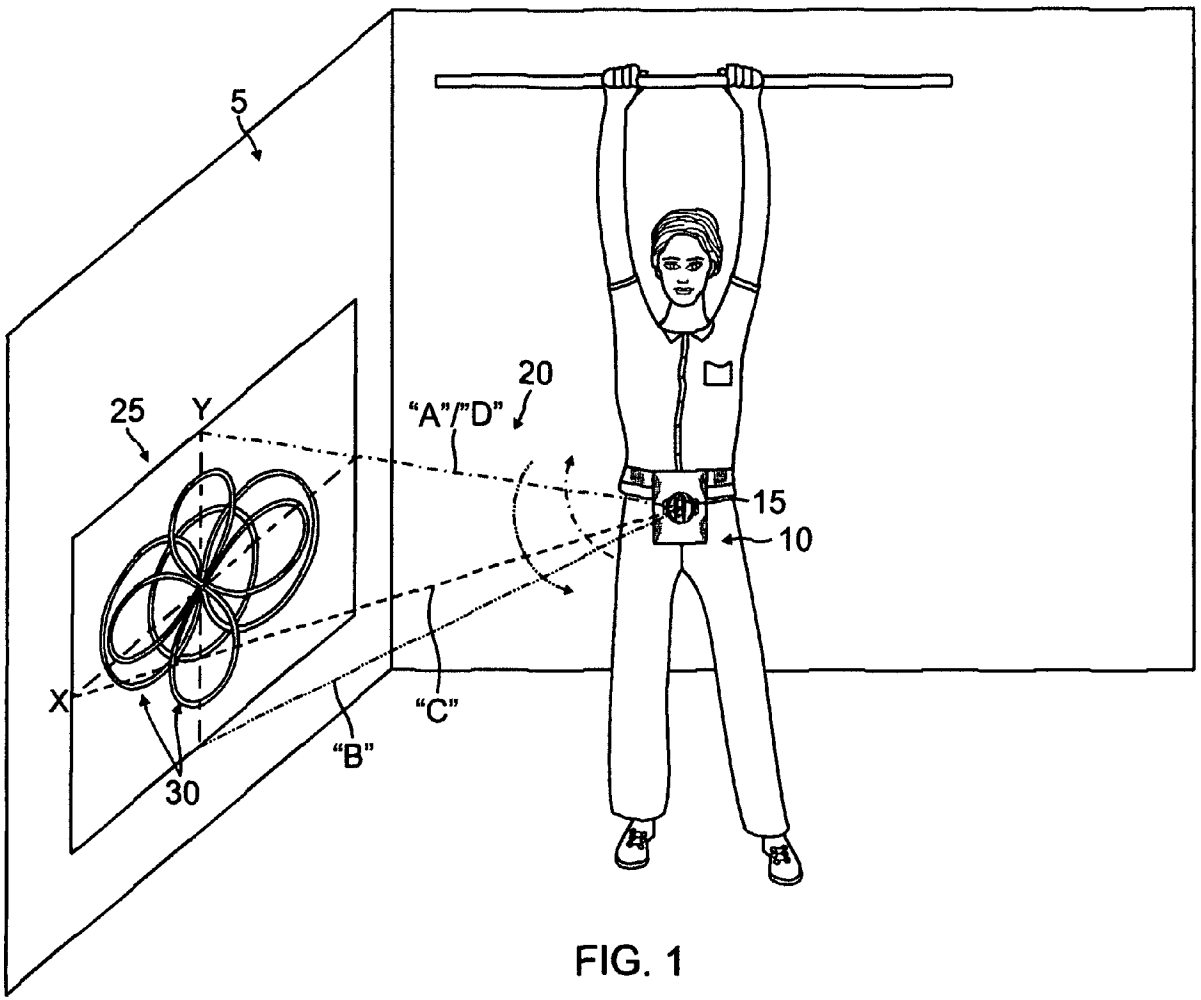
FIG. 1 is a perspective view of one embodiment of the conditioning apparatus including an illumination source and a target.

Exemplary embodiments will now be described with references to the accompanying figures, with like reference numerals referring to like elements throughout. The terminology used in the description is not intended to be interpreted in any limited or restrictive manner, simply because it is being utilized in conjunction with a detailed description of certain embodiments. Furthermore, various embodiments (whether or not specifically described herein) may include novel features, no single one of which is solely responsible for its desirable attributes or which is essential to practicing the subject matter described herein. As indicated above, the subject matter described herein relates to a conditioning apparatus having an illumination source such as a laser device for projecting a laser beam to a target for use as a point of reference during, among other things, operation of the conditioning device. The conditioning apparatus is configured and designed to improve the flexibility, strength, and control, of among other things, the hips and core structure of a user, while ingraining patterns of movement directly applicable to comparable movements used in a variety of sporting endeavors.

Such patterns of movement and their corresponding sporting activities include the swing of a golf club, a baseball bat, and a tennis racket, as well as other endeavors where rotational movement of the hips and core structure including associated muscle groups are activated. In this regard, the conditioning apparatus described herein includes an illumination source having a laser device to project a laser beam to a target to provide a precise and continuous real time visual representation of the user's body movement to the user when performing movement patterns designed to condition the user's hips and core structure for participating in various sporting activities. In one embodiment, such visual representations, which track the user's body movement via the laser beam, are projected onto a target having predetermined movement pattern(s) printed thereon so that the user may attempt to follow or trace the movement pattern(s) with the user's own movement to thereby increase flexibility, strength, and control of the user's hips and core structure.

In another embodiment, the laser beam used to track the user's body movement is projected onto a light sensitive target configured to convert the light received from the laser device into digital data capable of being stored on a computer readable medium or similar storage device for later viewing and analysis by the user.

FIG. 1 is a perspective view of one embodiment of the conditioning apparatus. The conditioning apparatus 5 includes an illumination source 10 for projecting a light. More specifically, the illumination source 10 may include a laser device 15 for projecting a laser beam 20, and a target 25 spaced apart from the illumination source 10 for receiving the laser beam 20. The target 25 includes predetermined movement patterns 30 printed thereon.

Figure 2:
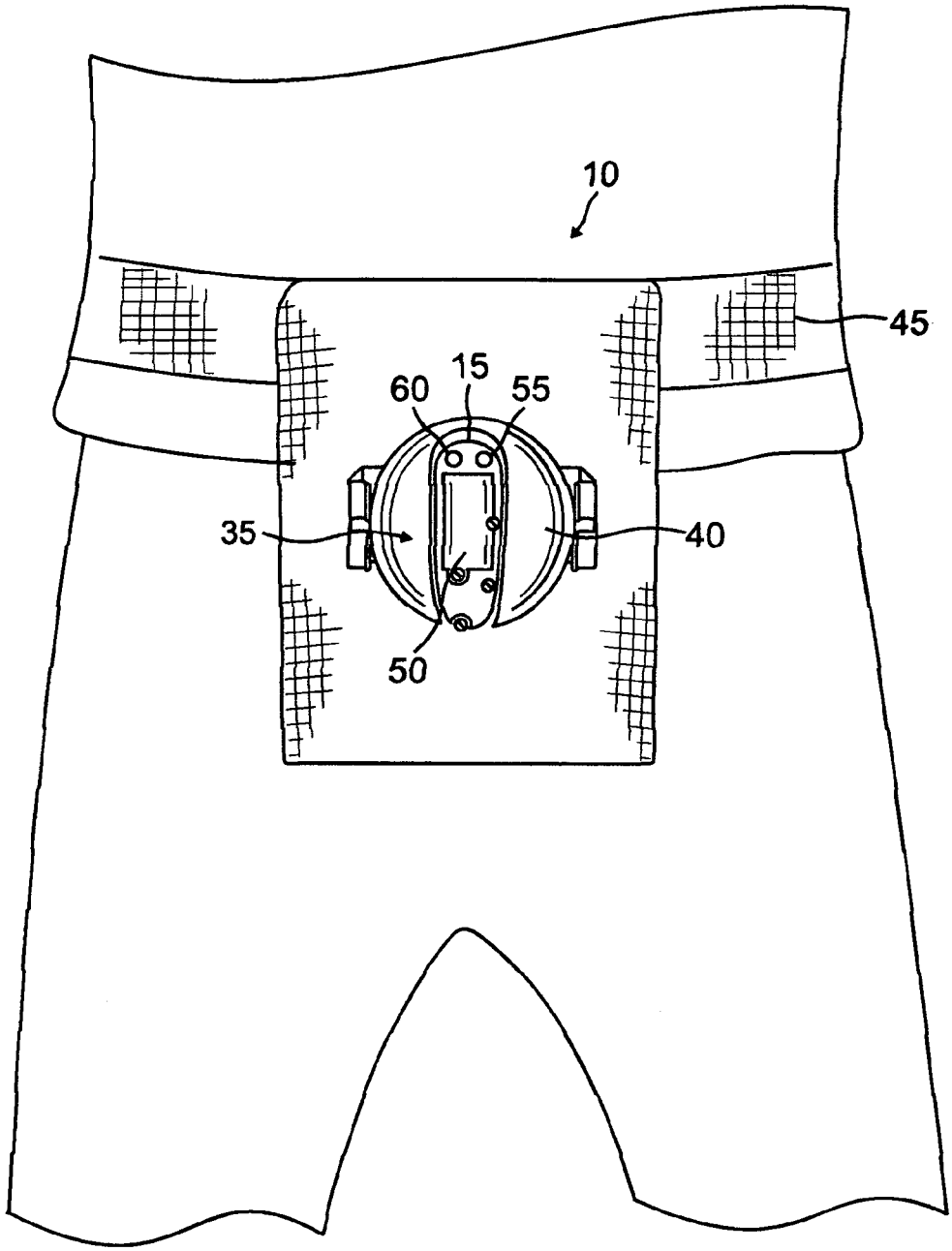
FIG. 2 shows one embodiment the illumination source including a molded housing configured to enclose a laser device, a mounting stage for mounting the molded housing, and a waist belt for securing the illumination source to the body of a user.

More specifically, as shown in FIG. 2, in one embodiment the illumination source 10 includes a molded housing 35 constructed of plastic such as polypropylene or similar durable impact resistant material and configured to enclose the laser device 15 along with associated circuitry and components for operation of the laser device 15, a mounting stage 40 for mounting the molded housing 35, and a waist belt 45 for securing the illumination source 10 to the body of a user.

The molded housing 35 further includes a battery compartment 50 for housing a power source such as a battery or batteries for powering the laser device 15. In one embodiment the laser device 15 may be lower power and may be powered by a CR2 type battery. Persons of skill in the art will understand that other battery types including a rechargeable battery may be utilized depending on the type of laser device 15 used and its associated power requirements and characteristics. A power on/off switch 55 may be provided on the molded housing 35 for activating or deactivating (turning "on" or "off") the laser device 15 as needed. An orifice or aperture 60 may be further provided on the molded housing 35 to permit projection of the laser beam 20 from the laser device 15 to the target 25.

In one embodiment the optional mounting stage 40 is provided. The mounting stage 40 may be constructed of plastic, Styrofoam, or other suitable material, and is configured to provide a stable platform for mounting the molded housing 35 to the waist belt 45. The waist belt 45 is generally configured to be adjustable for use with a variety of users and may be secured to the user by Velcro, a buckle system, or the like.

Figure 3:
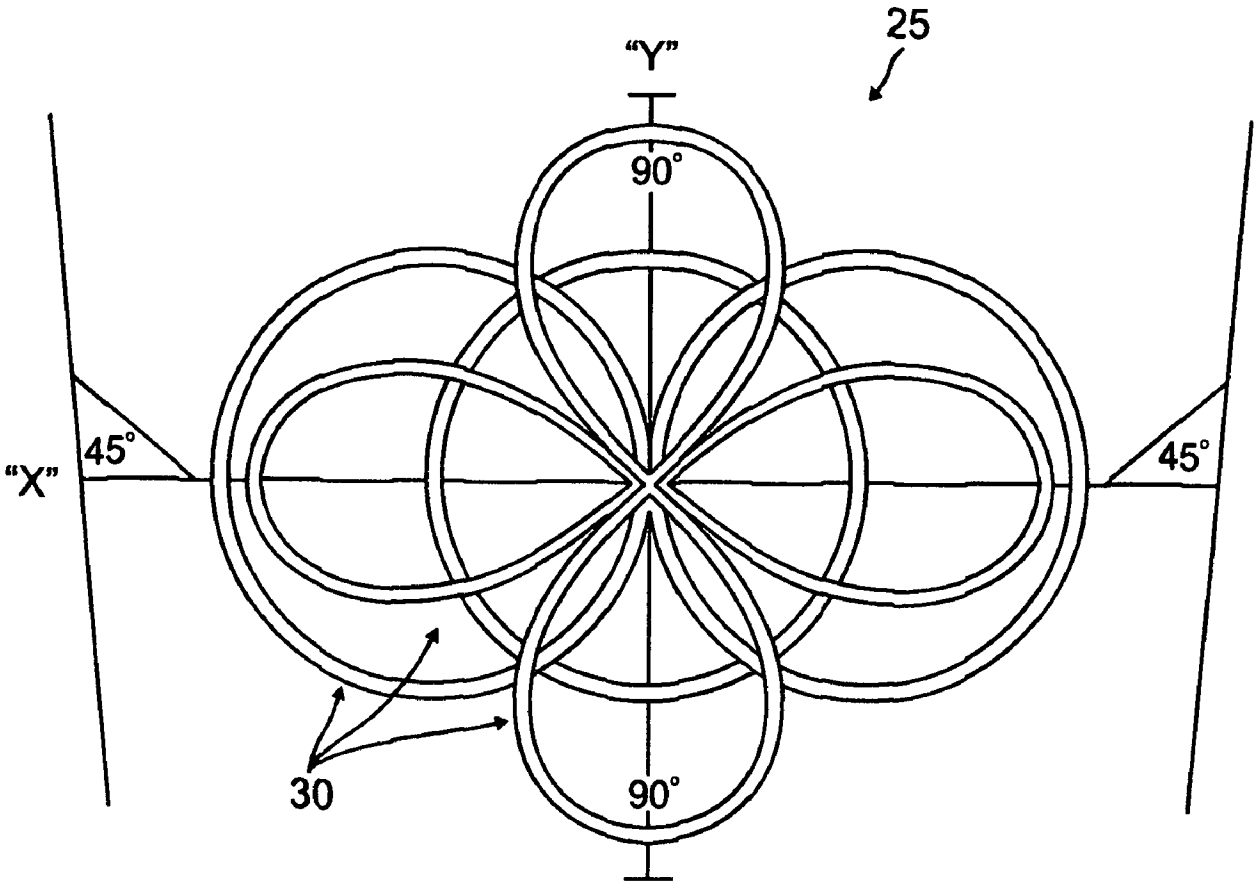
FIG. 3 shows one embodiment of a target for use with the illumination source of FIG. 1.

FIG. 3 shows one embodiment of a target 25 for use with the illumination source 10 of the conditioning apparatus 5. As indicated above, the target 25 includes one or more movement patterns 30 printed thereon. The movement patterns 30 may include circular, oval, elliptical, figure-eight, etc., movement patterns formed alone or in combination upon an X and Y Cartesian coordinate system that are designed to improve the flexibility, strength, and control, of among other things, the hips and core structure of a user, while ingraining patterns of movement directly applicable to comparable movements used in a variety of sporting endeavors.

In one embodiment, a method of conditioning utilizing the conditioning apparatus 5 describe herein may include a preliminary warm-up including stretching of the user's limbs and torso, and generally increasing heart rate, and blood flow within the body. As indicated above and shown in FIG. 1, the sports conditioning apparatus 5 described herein includes an illumination source 10 having a laser device 15 for projecting a laser beam 20 as a point of reference so as to provide a user of the conditioning apparatus 5 with a precise and continuous real time visual representation of the user's body movement when following or tracing the one or more movement patterns 30. In this regard, following the warm-up, the conditioning apparatus 5 is positioned generally about the hip region of the user and secured such that the laser device 15 is place near the middle of the waist, perpendicular to the user, and approximately two feet from the target 25. The laser beam 20 is then projected onto the center of target where the X-axis and Y-axis cross.

The target 20 includes the movement patterns 30 printed thereon so that the user may attempt to follow or trace the movement patterns 30 with the user's own movement to thereby increase flexibility, strength, and control of the user's hips and core structure. In this regard, the hips of the user are used to move the laser beam 20 to trace the movement patterns 30 printed on the target 25 while following precise guidelines for postural alignment, appropriate use of force or muscle control, and number of repetitions or pattern tracing while progressing through various levels of pattern difficulty. In one embodiment, a straight object of an appropriately length such as a golf club, baseball bat, or stick, may be held by the user directly over the user's head with the hands spaced apart from each other about shoulder width. This may be done to better isolate the hips or pelvis of the user and to encourage movement of the hips independent of the shoulders.

Conditioning movements are those movements made by the user wearing the illumination source that attempt to trace one or more of the movement patterns of the target. One such conditioning movement of the conditioning apparatus 5 may include a vertical pelvis movement in which the user may be made to stand up straight with feet parallel to the target 25 and knees slightly bent. The lower abdominals are contracted to perform a posterior pelvic tilt that results in the laser beam 20 being projected upward in a vertical direction along the Y-axis of the target 25 as shown by laser line "A". The user may be encouraged to move the laser beam 20 upward as high as possible using only the posterior pelvic tilt. In this regard, it is important not to lean back or otherwise move the upper body. The head, shoulders, and ribcage should remain stationary.

The vertical pelvis movement is now reversed in that the pelvis is brought back by contracting the lower back so that the laser beam moves downward in a vertical direction through the center of the target along the Y-axis as shown by laser line "B". As before, it is important not to lean forward or otherwise move the upper body.

Conditioning movements of the conditioning apparatus 5 may include a horizontal pelvis movement in which the user may be made to stand up straight with feet parallel to the target 25 and knees slightly bent. The hips are twisted or rotated to the left so the laser beam 20 is projected in a horizontal direction along the X-axis as shown by laser line "C". The user may be encouraged to move the laser beam 20 to the left as far as possible. In this regard, it is important to keep upper body including the head completely still, and the knees forward and feet flat on the floor. The head, shoulders, and ribcage should remain stationary. The hips are then rotated horizontally in the opposite direction along the Y-axis as indicated by laser line "D".

Conditioning movements of the conditioning apparatus 5 may further include a circular pelvic movement in which the user may be made to stand up straight with feet parallel to the target 25 and knees slightly bent. The hips are moved into an anterior pelvic tilt by contracting the lower back resulting in the laser beam 20 being projected at a downward angle near the middle portion of the circular movement pattern. Keeping the head, shoulders, and ribcage still, the abdominals and pelvis are used to cause a posterior pelvic tilt resulting in the laser beam 20 moving to the left of center on the target 25 from 6 o'clock to 12 o'clock in a half circle shape. The laser beam 20 is moved continually clockwise on the right of center on the target 25 from 12 o'clock and returning to 6 o'clock to form a circle. The user should strive for a smooth trace of the circle movement pattern. The circular pelvic conditioning movement may be repeated by moving the laser beam 20 in the opposite direction to form a circle.

Conditioning movements of the conditioning apparatus 5 may further include a vertical figure eight pelvic movement in which the user may be made to stand up straight with feet parallel to the target 25 and knees slightly bent. In this conditioning movement, with the laser beam 20 placed in the center of the target the pelvis is moved upward and to the left to trace the laser beam 20 around the top portion of the ellipsis shown in FIG. 1. The laser beam 20 is then moved back to the center of the target, around the bottom portion of the ellipse until tracing of the figure eight movement pattern is completed. The vertical figure eight pelvic movement may be repeated in the opposite direction. The user should strive for a smooth trace of the vertical figure eight movement pattern in order to develop fluid rhythm that is crucial in the conductivity and transfer of power.

Conditioning movements of the conditioning apparatus 5 may further include a horizontal figure eight pelvic movement in which the user may be made to stand up straight with feet parallel to the target 25 and knees slightly bent. In this conditioning movement, with the laser beam 20 placed in the center of the target the pelvis is used to move the laser beam 20 along the right portion of the ellipsis, back to center, along the left portion of the ellipsis, and back to center to complete the tracing of the horizontal figure eight movement pattern. As with other conditioning movements, the horizontal figure eight pelvic movement may be repeated in the opposite direction. The user should strive for a smooth trace of the horizontal figure eight movement pattern, and to keep the head, shoulders, and legs as stationary as possible.

As indicated above, the conditioning apparatus 5 is configured and designed to improve the flexibility, strength, and control, of among other things, the hips and core structure of a user, while ingraining patterns of movement directly applicable to comparable movements used in a variety of sporting endeavors. In addition, the conditioning apparatus 5 generally increases the ability to generate force from the largest muscles of the body, improves stability, control of balance, and posture, as well as develops the ability to coordinate the upper and lower body, and the ability to create and deliver increased rotational acceleration and power.

As indicated above, the laser beam used to track the user's body movement may be projected onto a light sensitive target configured to convert the light received from the laser device into digital data capable of being stored on a computer readable medium or similar storage device for later viewing and analysis by the user. Such storage of digital tracing information may be coupled with video-taping of the user performing the conditioning movements. In this regard, the user may review the combination of digital tracing and video taping of the conditioning movements preformed by the user to better isolate problem areas and to fine tune body movements to achieve superior conditioning of the hips and core structure.

The apparatus and methods of the present invention have been described with some particularity, but the specific designs, constructions and steps disclosed are not to be taken as delimiting of the invention. Obvious modifications will make themselves apparent to those of ordinary skill in the art, all of which will not depart from the essence of the invention and all such changes and modifications are intended to be encompassed within the appended claims.

What is claimed is:

1. A conditioning apparatus for conditioning the body of a user, the conditioning apparatus comprising:

a target having printed thereon a traceable pattern; and an illumination source spaced apart from the target, the illumination source configured to project a light upon the pattern, the projected light corresponding to the movement of the user having the illumination source positioned thereon and tracing the pattern with the light.

2. The conditioning apparatus of claim 1, wherein the illumination source is positioned on the hip region of the user.

3. The conditioning apparatus of claim 1, wherein the illumination source is spaced approximately two feet from the target.

4. The conditioning apparatus of claim 1, wherein the light from the illumination source is a laser beam.

5. The conditioning apparatus of claim 1, wherein the traceable pattern is one of a circle, an oval, an ellipse, or a figure eight.

6. The conditioning apparatus of claim 5, wherein the traceable pattern includes each of a circle, an oval, an ellipse, and a figure eight.

7. The conditioning apparatus of claim 1, wherein the traceable pattern of the target is light sensitive and configured to convert the light received from the illumination source into digital data.

8. A conditioning method for conditioning the body of a user, the conditioning method comprising:

positioning a target having a traceable pattern printed thereon;

spacing apart from the target an illumination source configured to project a light;

projecting the light from the illumination source onto the pattern; and tracing the pattern with the light in response to movement of the illumination source by the user having the illumination source positioned thereon.

9. The conditioning method of claim 7, further including positioning the illumination source on the hip region of the user.

10. The conditioning method of claim 7, further including spacing the illumination source approximately two feet from the target.

11. The conditioning method of claim 7, wherein the light from the illumination source is a laser beam.

12. The conditioning method of claim 7, wherein the traceable pattern is one of a circle, an oval, an ellipse, or a figure eight.

13. The conditioning method of claim 11, wherein the traceable pattern includes each of a circle, an oval, an ellipse, and a figure eight.

14. A conditioning apparatus for conditioning the body of a user, the conditioning apparatus comprising:

a target having a traceable pattern; and an illumination source spaced apart from the target, the illumination source configured to project a light upon the pattern, the projected light corresponding to the movement of the user having the illumination source positioned thereon and tracing the pattern with the light.

* * * * *